US006712251B2

(12) United States Patent
Godshaw et al.

(10) Patent No.: US 6,712,251 B2
(45) Date of Patent: Mar. 30, 2004

(54) LOW SLUNG TOOL CARRIER

(75) Inventors: Donald E. Godshaw, Evanston, IL (US); Andrezj M. Redzisz, Wheeling, IL (US)

(73) Assignee: Travelon, Des Plaines, IL (US)

( * ) Notice: Subject to any disclaimer, the term of this patent is extended or adjusted under 35 U.S.C. 154(b) by 0 days.

(21) Appl. No.: 10/339,902

(22) Filed: Jan. 10, 2003

(65) Prior Publication Data

US 2003/0102344 A1 Jun. 5, 2003

Related U.S. Application Data

(62) Division of application No. 09/921,125, filed on Aug. 2, 2001, which is a continuation of application No. 09/359,339, filed on Jul. 21, 1999, now Pat. No. 6,390,348.

(60) Provisional application No. 60/222,713, filed on Aug. 3, 2000.

(51) Int. Cl.[7] ..... A45F 3/02

(52) U.S. Cl. ..... 224/675; 224/637; 224/260; 224/904

(58) Field of Search ..... 224/606, 627, 224/628, 637, 639, 260, 675, 904, 660, 663, 666, 669, 677, 682, 684

(56) References Cited

U.S. PATENT DOCUMENTS

| | | | | | |
|---|---|---|---|---|---|
| 119,400 | A | * | 9/1871 | Penrose | 224/148.6 |
| 770,761 | A | * | 9/1904 | Lemly | 224/649 |
| 1,723,147 | A | * | 8/1929 | Fourethier | 224/197 |
| 4,269,179 | A | * | 5/1981 | Burton et al. | 602/36 |
| 4,320,863 | A | * | 3/1982 | Lyer et al. | 224/259 |
| 4,422,452 | A | * | 12/1983 | Burton | 602/36 |
| 5,201,448 | A | * | 4/1993 | Schue | 224/675 |
| 5,413,262 | A | * | 5/1995 | Dewire et al. | 224/675 |
| 5,548,843 | A | * | 8/1996 | Chase et al. | 2/102 |
| 5,586,969 | A | * | 12/1996 | Yewer, Jr. | 602/19 |
| 5,630,536 | A | * | 5/1997 | Bugnaski | 224/600 |
| 5,776,087 | A | * | 7/1998 | Nelson et al. | 602/19 |
| 5,988,315 | A | * | 11/1999 | Crane | 182/3 |
| 6,213,365 | B1 | * | 4/2001 | Stocke et al. | 224/665 |
| 6,390,348 | B1 | * | 5/2002 | Godshaw et al. | 224/674 |
| 2003/0102346 | A1 | * | 6/2003 | Chen | 224/675 |

* cited by examiner

*Primary Examiner*—Stephen K. Cronin
*Assistant Examiner*—Joseph C. Merek
(74) *Attorney, Agent, or Firm*—Banner & Witcoff, Ltd.

(57) ABSTRACT

A low slung tool belt carrier includes pouches designed to be suspended from a belt strap construction with a shoulder strap crossing over the torso or shoulders to support the larger of two pouches, the pouches arranged to fit on the hips or be rested upon the hips of an individual.

3 Claims, 6 Drawing Sheets

LOW SLUNG TOOL CARRIER

CROSS REFERENCE TO RELATED APPLICATIONS

This is a division of Ser. No. 09/921,125 filed Aug. 2, 2001 for "Low Slung Tool Carrier" which is a continuation in part of Ser. No. 09/359,339 filed Jul. 21, 1999 for "Tool Belt" (now issued as U.S. Pat. No. 6,390,348),and provisional application Ser. No. 60/222,713 filed Aug. 3, 2000 for "Low Slung Carrier" (abandoned) all of which are incorporated herewith by reference and for which priority is claimed.

BACKGROUND OF THE INVENTION

In a principal aspect the present invention relates to a tool belt and, more particularly, to a tool belt of the type which includes a number of storage pockets and adjustable belt support members.

Construction workers, tradesman and the like typically use a tool belt attached about their waist to transport and maintain tools at a work site. Such belts are often fabricated from canvas and/or leather and may include a number of pockets or pouches which are designed to hold tools such as pliers, screwdrivers and the like. Desirable characteristics for such belts are durability and the capability to hold and store many tools and other items. The belts must also be comfortable and yet durable in order to withstand rugged circumstances. Additionally, such a belt must be designed to accommodate various types of tools and if possible permit alteration and adjustment in order to accommodate various types of tools, various sizes of tools and various sizes of workmen. Thus, there has remained a need for an improved tool belt which is comfortable to wear, rugged, economical and easily adapted for multiple uses.

SUMMARY OF THE INVENTION

Briefly the invention comprises a tool carrier which includes an adjustable strap or belt having first and second tool pockets or pouches affixed thereto and spaced one from the other by a distance which enables the pouches to rest comfortably on the opposite hips of a user of the tool belt. A shoulder strap, which is designed to cross over the torso of an individual, has opposite ends connected adjacent the opposite sides of one of the pockets, preferably the larger of the storage pockets. The belt may thus rest upon the hips of an individual with a larger pocket resting on one hip and with a shoulder strap supporting the larger pocket by crossing the torso and extending over one shoulder on one side of the individual to the pocket on the opposite side of the individual. Alternative constructions include first and second shoulder straps connected to opposite sides of the front of the belt strap attached to a single strap that extends down the back of an individual and is then connected to the belt or tool carrier waist strap.

Thus it is an object of the invention to provide an improved tool carrier.

It is a further object of the invention to provide a tool carrier which incorporates a tool belt in combination with the various types of shoulder straps and tool pockets or pouches.

Another object of the invention is to provide a tool carrier which may be "low slung" or in other words, supported on the hips of an individual.

Another object of the invention is to provide a tool carrier made from a flexible yet rugged material such as leather, canvas or other flexible fabric materials.

A further object of the invention is to provide a tool carrier which includes tool pockets positioned on the left and right hand side of an individual, preferably over the hips, with a supplemental shoulder strap(s) either crossing the torso or fitting over the shoulders of an individual with a single strap extending down the back of an individual and connected to the tool belt.

Yet another object of the invention is to provide a tool carrier which permits adjustment of tool pockets suspended from a tool belt.

These and other objects, advantages and features of the invention are set forth in the detailed description which follows.

BRIEF DESCRIPTION OF THE DRAWING

In the detailed description which follows reference will be made to the drawing comprised of the following Figures.

DESCRIPTION OF THE PREFERRED EMBODIMENT

Figure 2:
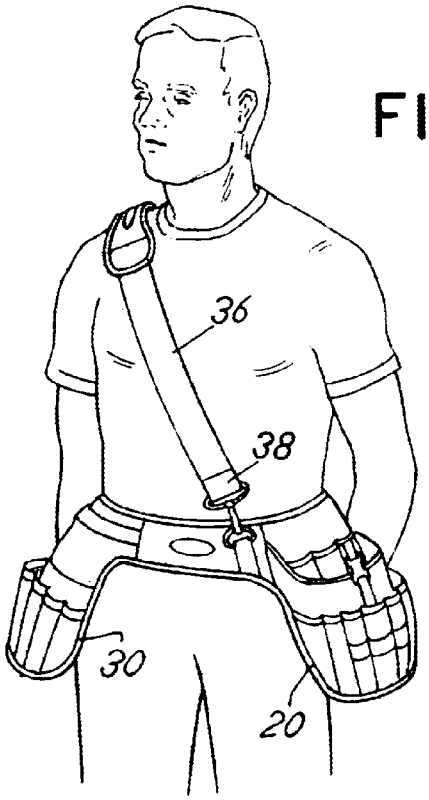
FIG. 2 is an isometric view of the tool carrier of the invention as it is worn by a person.

In the embodiment of FIGS. 1 through 4 the tool carrier comprises a belt or waist strap 10 having a first end 12 and a second end 14. The ends 12 and 14 include fasteners, such as buckles 13, 15 which permit the ends 12, 14 to be attached one to the other. The fasteners 13, 15 are such that the length or the waist dimension of strap 10 may be altered depending upon the particular person or worker who is wearing the tool carrier and the position of the belt about the torso. The strap 10 further includes an upper margin 16 and a lower margin 18. A first set of pockets or pouch 20 comprises an extension of the lower margin 18 and includes multiple pockets such as pockets 22 and 24 for receiving and storing tools on other items. A support strap 26 is attached to strap 10 adjacent one side of pouch 20 to hold pouch 20 in a condition which provides support and enables retention of tools therein. The first pouch 20 is adjacent to the second end 14 of the strap 10. A second pouch 30 also extends downwardly from the lower margin 18 and includes pockets, for example, pocket 32 for additional tools. First pouch 20 and second pouch 30 are separated by length 17 of strap 10 so that pouches 20, 30 fit respectively over a hip of a worker.

A shoulder strap 36 includes a first end 38 which is attached by means of a buckle 40 to a ring 42 attached to strap 10 adjacent the inner end 25 of the pouch 20 thereby permitting rotational adjustment of the strap 36. The shoulder strap 36 further includes an adjustable, medial shoulder pad 44. A second end 46 of the strap 36 is attached adjacent the second end 14 of the waist strap 10 and adjacent pouch 20 opposite inner end 25. The strap 36 is adjustable in length in the preferred embodiment and includes an overlapping section 48 of the strap 36 that may be adjusted with respect to the buckle 40.

All the straps and pouches are made from a flexible fabric material. When being utilized, the tool carrier strap 10 is positioned around the waist of the individual in a manner which enables strap 10 to rest upon the hips of such the individual, as shown in FIG. 2, with pouches 20, 30 aligned with each hip. The strap 36 is then adjusted and placed across the shoulder of the individual. Note that the first end 38 of the strap 36 is between the first pouch 20 and the second pouch 30, though in closer proximity to the first pouch 20. The ends of the strap 36 are positioned approximately an equal distance from the opposite sides of the first pouch 20 to facilitate support of the larger first pouch 20 by arranging the strap 36 to extend diagonally across the torso of the individual carrying the tool carrier.

Figure 1:
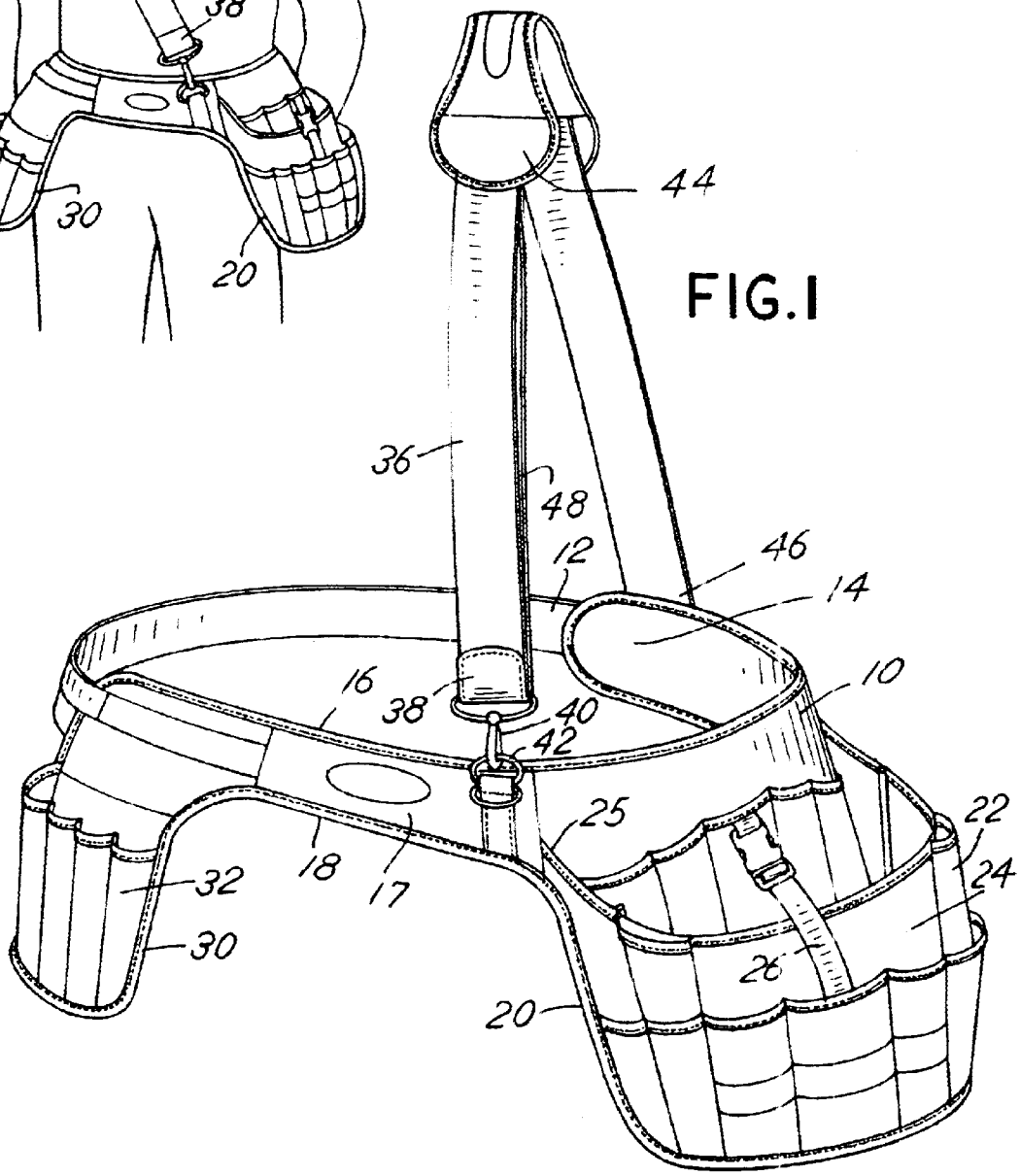
FIG. 1 is an isometric view of the tool carrier of the invention.
Figure 3:
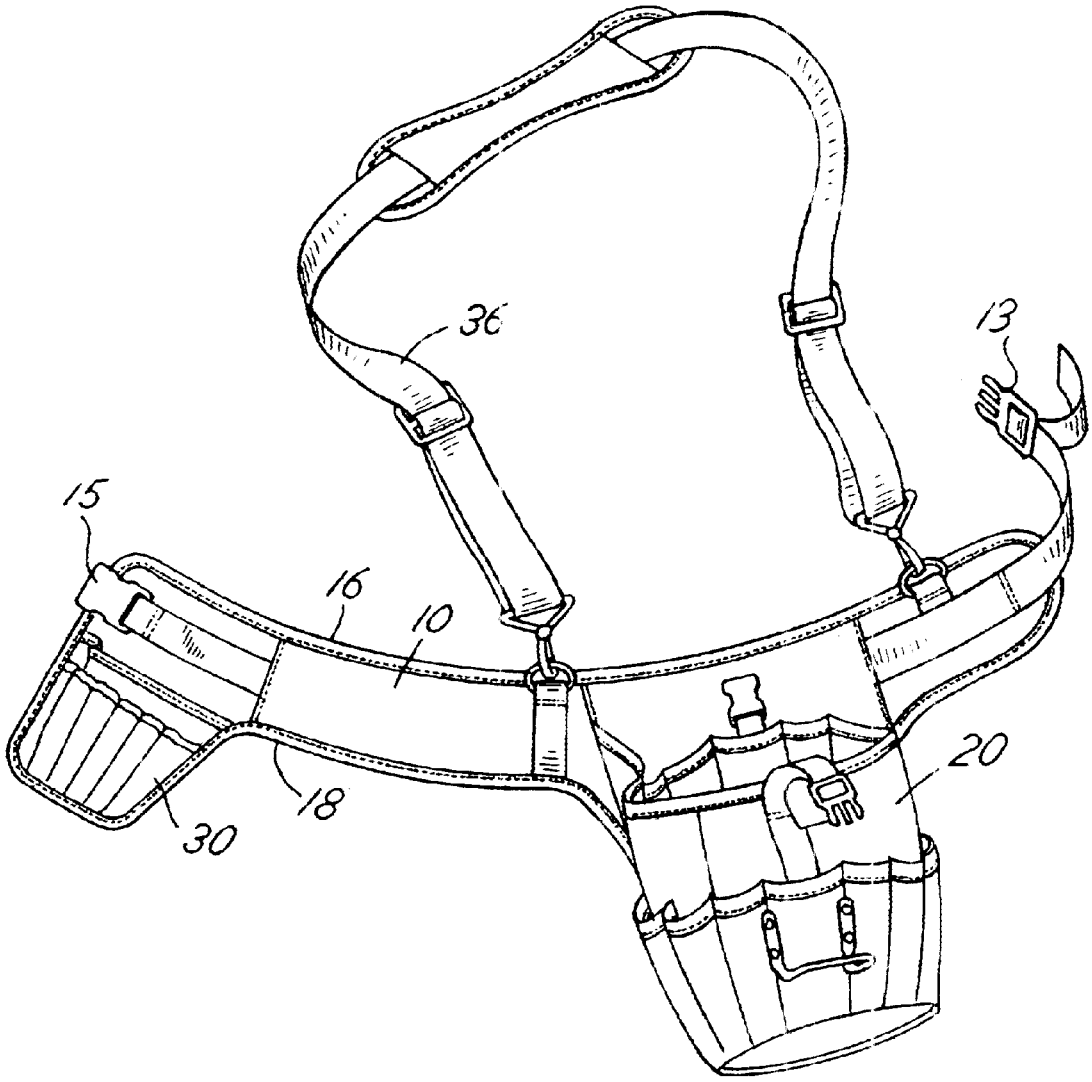
FIG. 3 is a plan view of the tool carrier of FIG. 1.

FIG. 3 depicts the embodiment of FIGS. 1 and 2 with the buckle 13, 15 for connecting the strap 10 detached and further depicting the shoulder strap 36 arranged with its connections to the strap 10 on opposite sides of the oversized or larger pouch 20. The pouch 20 is a larger pouch relative to the pouch 30 in as much as the pouch 20 rests upon the hip of an individual and is supported by the shoulder strap 36 which fits over on the shoulder of an individual and crosses the torso as depicted in FIG. 2.

Figure 4:
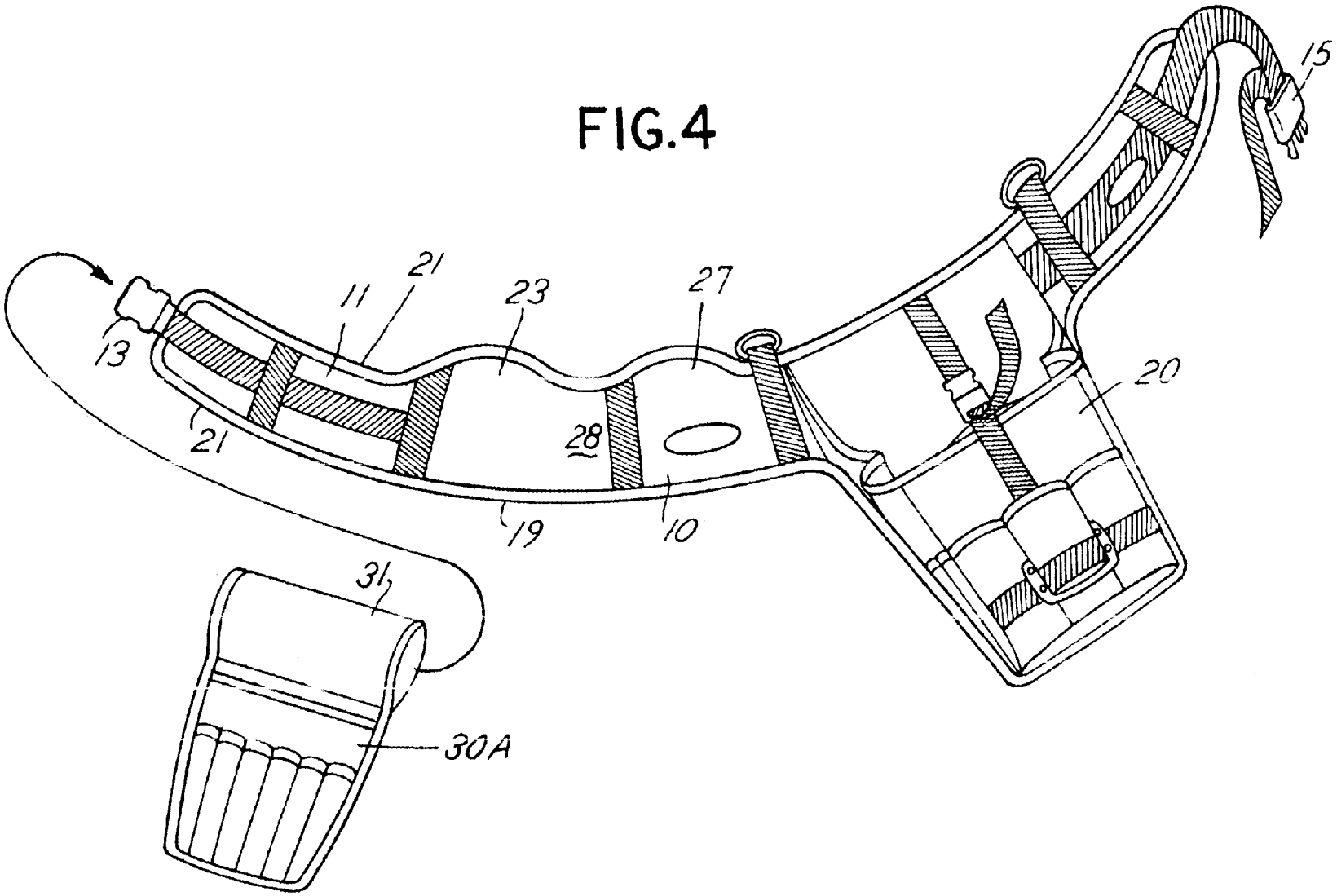
FIG. 4 is a plan view of an alternative construction of the belt and pockets similar to the embodiment depicted in FIGS. 1 and 2.

FIG. 4 illustrates an alternative embodiment of the construction of FIG. 3. The strap 10 does not include an integral pouch 30 but includes a replaceable pouch 30A in FIG. 4 which may slide or fit over the strap 10. Specifically a sleeve 31 is provided for the pouch 30A so that the sleeve 31 may fit over the end section 11 of the strap 10. Further, the strap 10 includes a straight width lower margin 19 and a straight upper margin 21 for section 11 with a first wide section 23 and a lesser width section 25 connected with a second wide section 27 for placement over the backside of an individual. The construction for the tool belt of FIG. 4 may thus be arranged so that the larger pouch 20 will fit on the right hand hip of an individual and the smaller pouch 30A will fit on the left hand hip with the strap 10 arranged around the back side of the individual so that the wider sections 23 and 27 will fit on opposite sides of the spine of an individual with the narrower strap section 28 aligned over the spine of an individual. This arrangement promotes the comfort of the belt when worn by an individual.

Figure 5:
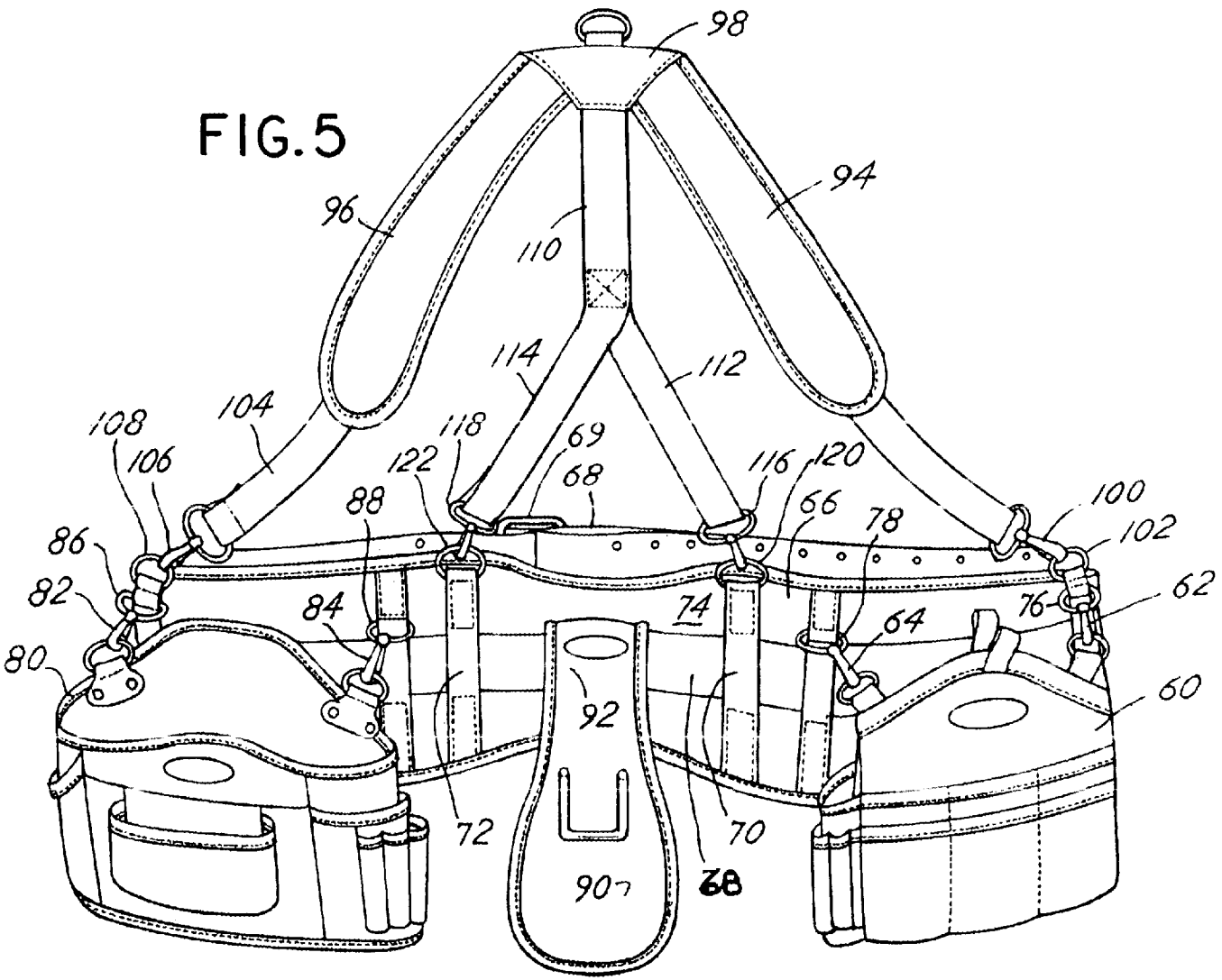
FIG. 5 is an alternative embodiment of a tool carrier incorporating dual shoulder straps.

FIGS. 5 through 8 illustrate two further embodiments of the invention wherein additional shoulder straps are provided for additional support of heavier tools on both hips and for a circumstance wherein large tool pouches are provided that fit over both hips or opposite sides of an individual wherein the pockets are generally equal size and will bear or hold equal weights of tools or other items. Referring therefore to FIG. 5, a first removable pouch 60 is attached by buckles 62 and 64 to a strap 66. The strap 66 will encircle the waist of an individual and includes a connecting belt 68. In the embodiment shown the strap 66 thus includes a series of loops, for example, loops 70 and 72 which receive a belt 68 that encircles the outside face 74 of the strap 66 and connects together by virtue of the belt buckle 69 around the waist or midsection of an individual.

The pouch 60 is attached to metal loops, such as loop 76 and 78, attached to the main strap 66. A second pouch 80 is similarly attached by means of buckles 82 and 84 to metal loops 86 and 88 attached to the strap 66. Note that with this construction the size and configuration of pouches 60 and 80 may be altered or changed as desired. Additionally, in as much as the belt 68 is provided additional items such as tool holder 90 supported by a loop 92 may be held on the strap 66 by the belt 68.

The embodiment of FIG. 5 includes a double shoulder strap comprising a left hand shoulder strap 94 and a right hand shoulder strap 96 which extend respectively from a yoke 98. Strap 94 is adjustably connected to a buckle 100 that is affixed to a metal loop 102 attached to the strap 66. In a similar fashion the right hand strap 96 is attached to an extension 104 that is attached by a buckle 106 to a metal loop 108 attached to the strap 66.

The yoke 98 connects with a single downwardly extending strap 110 that connects with divergent support straps 112 and 114. The straps 112 and 114 are affixed by a buckle 116 and 118 respectively to loops 120 and 122 attached to the strap 66. The right hand shoulder strap 94 thus fits over the right shoulder of an individual. The left hand strap 96 fits over the left shoulder of an individual and the back strap 110 fits down the back along the spine of an individual. All the straps and buckles are adjustable to provide the most appropriate balance and distribution of weight.

Figure 6:
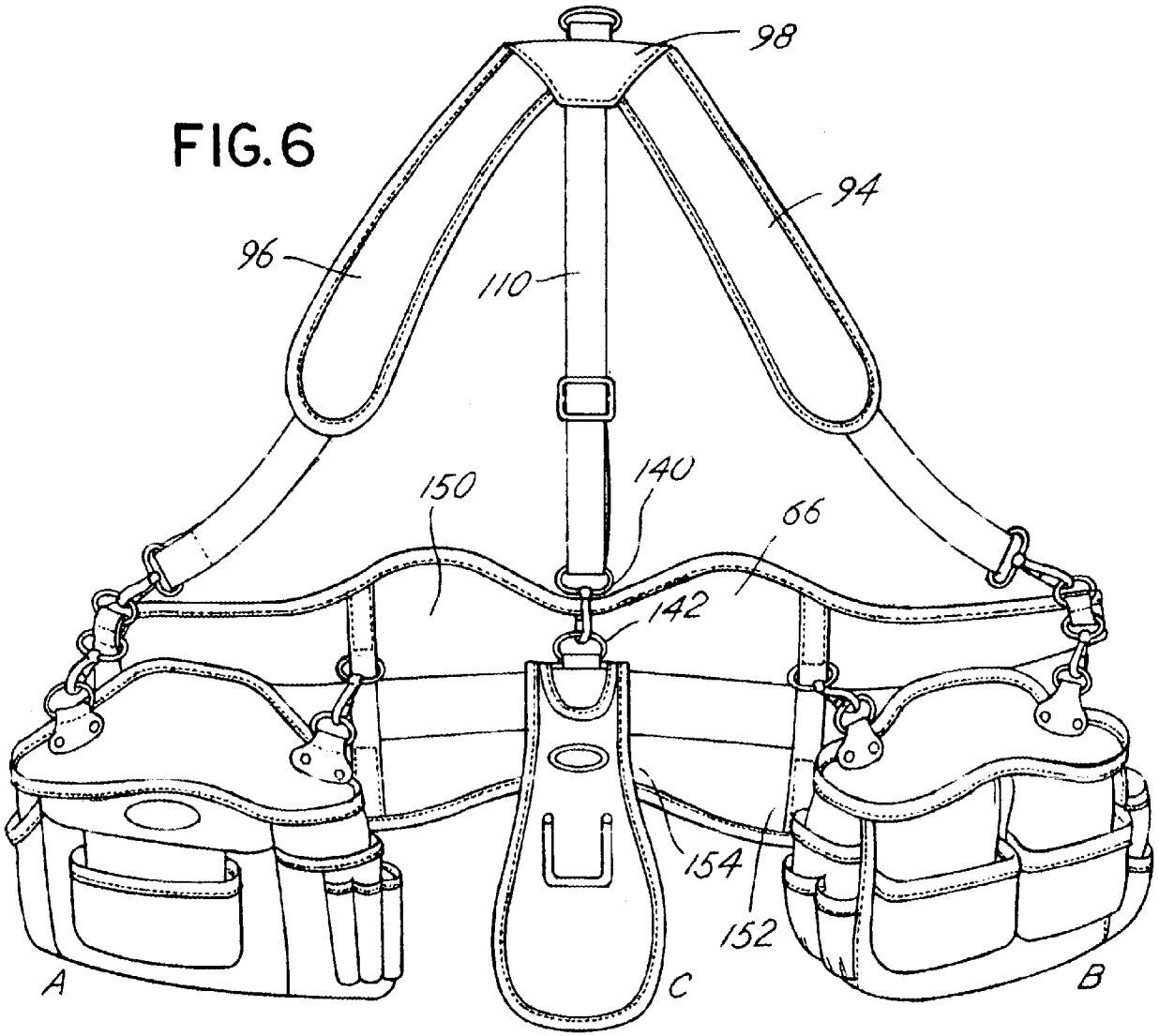
FIG. 6 is an alternative embodiment of a tool carrier incorporating dual shoulder straps and a single back strap.

FIG. 6 illustrates an alternative to the embodiment of FIG. 5. In FIG. 6, the construction is substantially identical to that of FIG. 5 except that the right shoulder strap 94 and the left shoulder strap 96 are connected to a yoke 98 that extends and connects with a single back strap 110 that is adjustable and connected by means of a single buckle 140 to a single metal loop 142 attached to the midpoint of strap 66. The strap 110 thus extends downwardly along the spine of an individual and is adjustable.

Figure 7:
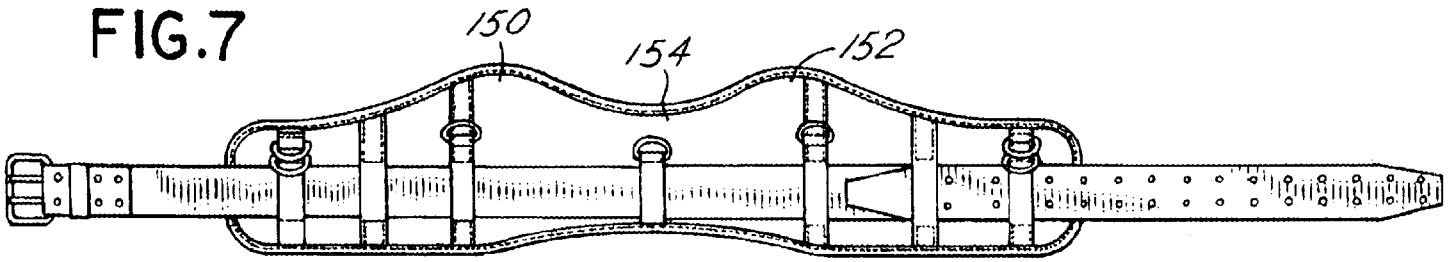
FIG. 7 is a plan view of the strap and belt construction of the carrier of FIGS. 5 and 6.
Figure 8:
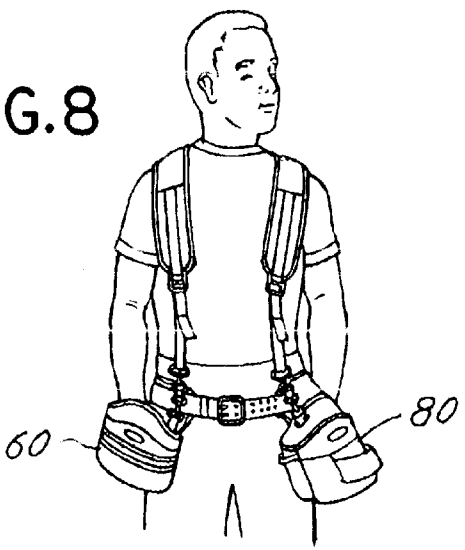
FIG. 8 is an isometric view of the tool carrier of FIG. 5 as worn by an individual.
Figure 9:
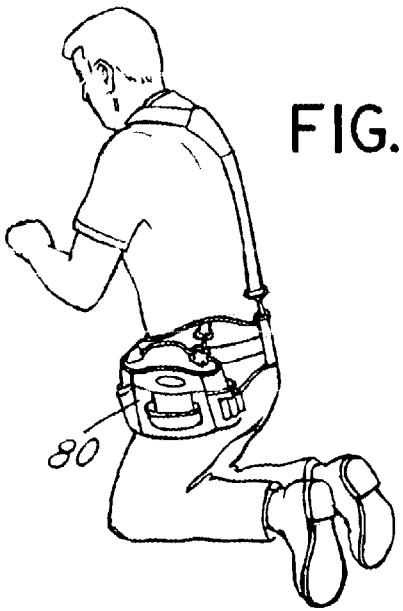
FIG. 9 is another isometric view of the tool carrier of FIG. 5 illustrating the manner of wearing the tool carrier.

As shown in FIG. 7, the back strap 66 is configured with a first left hand wide section 150 and a second right hand wide section 152 separated by an narrow spine section 154 to provide support for the region of the kidneys of an individual wearing the carrier with the narrow portion aligned with the spine of an individual. This provides additional comfort and support for the individual wearing or using the belt as depicted in FIGS. 8 and 9.

It is possible to vary the construction without departing from the spirit and scope of the invention. Thus the straps may all be adjustable. The buckles and connectors may be of any various types. The pouches may be attachable or detachable or integrally incorporated in the strap. The carrier of the invention is therefore to be limited only by the following claims and equivalence thereof.

What is claimed is:

1. A tool carrier comprising, in combination:

a waist strap including a back with a midpoint, a first free end for placement on the left-hand side of a person and second free end for placement on the right-hand side of a person, a lower margin and an upper margin; an a plurality of belt loops attached to the waist strap;

a fastener mechanism for attaching the strap ends comprising a separable belt attached to the strap through the belt loops, said belt having a belt buckle connector;

a first pouch attached by buckles to said belt loops of the waist strap, said first pouch extending below the lower margin thereof for holding tools, said first pouch positioned for fitting on the hip of a person, said strap further including a second pouch attached by buckles to said fixed belt loops of the waist strap, said second pouch extending below the lower margin and positioned to rest on the other hip of a person;

first and second shoulder straps for fitting respectively over the left and right shoulder of an individual, said first strap attached to the waist strap intermediate the first free end and the first tool pouch, said second strap attached to the waist strap intermediate the second free end and the second pouch;

a connecting yoke for joining the first and second straps on the back of an individual; and a back strap connecting the yoke at the midpoint of the back of the waist strap.

2. The carrier of claim 1 including multiple pockets in each pouch.

3. The carrier of claim 1 including at least one adjustable length shoulder strap.

* * * * *